US007216824B2

(12) United States Patent
Katsumura et al.

(10) Patent No.: US 7,216,824 B2
(45) Date of Patent: May 15, 2007

(54) SHREDDER WITH OSCILLATING SIDE WALLS

(75) Inventors: Hikoichi Katsumura, Hirakata (JP); Saiji Yamashita, Hirakata (JP); Satoshi Ishii, Hirakata (JP)

(73) Assignee: Matsui MFG. Co. Ltd., Osaka (JP)

( * ) Notice: Subject to any disclaimer, the term of this patent is extended or adjusted under 35 U.S.C. 154(b) by 141 days.

(21) Appl. No.: 10/494,167

(22) PCT Filed: Jul. 28, 2003

(86) PCT No.: PCT/JP03/09551

§ 371 (c)(1),
(2), (4) Date: Apr. 29, 2004

(87) PCT Pub. No.: WO2004/026480

PCT Pub. Date: Apr. 1, 2004

(65) Prior Publication Data

US 2004/0245360 A1 Dec. 9, 2004

(30) Foreign Application Priority Data

Sep. 19, 2002 (JP) ..... 2002-272376

(51) Int. Cl.
*B02C 1/08* (2006.01)

(52) U.S. Cl. ..... 241/243; 241/237; 241/238; 241/239

(58) Field of Classification Search ..... 241/237, 241/238, 239, 243
See application file for complete search history.

(56) References Cited

U.S. PATENT DOCUMENTS 2,014,859 A * 9/1935 Mitchell, Jr. ..... 384/480
3,545,689 A * 12/1970 Luscombe ..... 241/186.4
3,708,127 A * 1/1973 Brewer ..... 241/32
4,678,126 A * 7/1987 Prentice et al. ..... 241/34
5,454,522 A * 10/1995 Ballu ..... 241/237
5,487,509 A * 1/1996 Hama ..... 241/152.2

(Continued)

FOREIGN PATENT DOCUMENTS

JP 61-3461 Y2 2/1986

(Continued)

OTHER PUBLICATIONS plas-aid, Produced by Matsui: Recycle Equipment, The low-speed type Granulater sweeper/SMGL Series; by Matsui; Jan. 31, 2002.

(Continued)

*Primary Examiner*—Lowell A. Larson
*Assistant Examiner*—Jason Y Pahng
(74) *Attorney, Agent, or Firm*—R. Neil Sudol; Henry D. Coleman; William J. Sapone

(57) ABSTRACT

A shredder for shredding a by-product, such as sprue, runner and the like generated when molding a thermoplastic synthetic resin product, into recyclable shredded pieces, is structured such that front and rear oscillating side walls are openable, right and left stationary side walls are connected by two support shafts and one connection member, and two support shafts serve as pivot axes of the oscillating side walls and connection members connecting the right and left stationary side walls.

4 Claims, 7 Drawing Sheets

U.S. PATENT DOCUMENTS 5,611,495 A * 3/1997 Williams ..... 241/73
5,906,322 A * 5/1999 Hama ..... 241/152.2

FOREIGN PATENT DOCUMENTS

JP 6-16016 3/1994
JP 3108384 5/1997
JP 3045106 U 1/1998
JP 10-118515 A 5/1998
JP 2001132764 A * 5/2001
JP 2002-1147 1/2002

OTHER PUBLICATIONS

Plucky; by Watanabe Seikosho; Sep. 2002.
Gran Cutter, Gran Mixer; by HARMO Co., Ltd.; Oct. 2002.
Scutter-Sx; by STOLZ Co., Ltd.; 2nd Edition, 2005.

* cited by examiner

SHREDDER WITH OSCILLATING SIDE WALLS

TECHNICAL FIELD

The present invention relates to a shredder which is suitable for shredding a by-product (a sprue, a runner and the like), for example, which is generated in accordance with a molding of a thermoplastic synthetic resin product, into reusable shredded pieces.

BACKGROUND ART

In conventional, the following structure is known as this kind of shredder.

There has been known a shredder comprising:

a lower casing which has an outlet in a lower portion and is formed in a rectangular plan shape;

an upper casing which is provided on the lower casing so as to be freely opened and closed by vertically oscillating movement, and is formed in a rectangular plan shape;

a rotary shaft which is rotatably provided between right and left side walls of the lower casing in the state of the axis thereof being in a lateral direction, and has a rotary blade;

a stationary blade which is provided in an inner side of a front wall of the upper casing and shreds a subject to be treated in cooperation with the rotary blade; and a scraper which is provided in an inner side of a rear wall of the upper casing, wherein the rotary blade is positioned between the stationary blade and the scraper (refer to Japanese Unexamined Utility Model Publication No. 6-16016).

The conventional shredder has the following defects.

Since the upper casing is freely opened and closed by oscillating movement with respect to the lower casing, however, the lower casing and the upper casing are formed in the rectangular frame shape in the plan view, there has been a defect that it is hard to perform a maintenance and a cleaning.

DISCLOSURE OF THE INVENTION

The present invention employs the following means in order to solve the defect mentioned above.

(1) In accordance with the invention described in claim 1, there is provided a shredder comprising:

right and left stationary side walls arranged with a predetermined interval;

front and rear support shafts bridged and fastened over lower portions of front end rear portions in the stationary side walls;

front and rear oscillating side walls provided to the support shafts so as to freely oscillate forward and backward and to be opened and closed;

connection members bridged and fastened over upper front portions of the right and left stationary side walls;

a rotary shaft rotatably bridged over the stationary side walls and having a rotary blade;

a stationary blade provided in an inner side of the front oscillating side wall and shredding a material to be treated in cooperation with the rotary blade; and a scraper provided in an inner side of the rear oscillating side wall, wherein the rotary blade is positioned between the stationary blade and the scraper, and wherein the rotary shaft is provided with an arm-shaped roughly cutting rotary blade and a finely cutting rotary blade having sawtooth-shaped shredding teeth in an outer periphery, a cover member for covering a moving locus space of the roughly cutting rotary blade is provided so as to be positioned below the stationary blade and the scraper, the cover member has a front member provided in the front oscillating side wall, a rear member provided in the rear oscillating side wall and an independent intermediate member connecting the front member to the rear member, and the intermediate member is detachably provided.

(2) In accordance with the invention described in claim 3, there is provided a shredder as claimed in claim 1, wherein the front and rear oscillating side walls are provided with bearing members for bearing the intermediate member of the cover member in the state of the front and rear oscillating side walls being opened, and the intermediate member of the cover member is structured such as to be prevented from moving frontward and rearward when the front and rear oscillating side walls are in an upright state, by the bearing member and the front member of the cover member provided in the front oscillating side wall, and the bearing member and the rear member of the cover member provided in the rear oscillating side wall.

(3) in accordance with the invention described in claim 4, there is provided a shredder as claimed in claim 1, wherein the stationary blade has a front member which is long in the right-and-left direction and is positioned in a front side of a moving locus of a leading end of the roughly cutting rotary blade, and a rear member which is provided independently from the front member and is separated at a position of the moving locus of the roughly cutting rotary blade.

(4) In accordance with the invention described in claim 5, there is provided a shredder as claimed in any one of claims 1, 3 and 4, wherein a left spiral portion is formed on an inner portion of a left end portion of the rotary shaft, a right spiral portion is formed on an inner portion of a right end portion of the rotary shaft, and the right and left spiral portions are formed so as to oppose to an inner surface of a hole to which the rotary shaft of the stationary side wall is fitted.

The present invention achieves the following effects in accordance with the structures mentioned above.

(1) In accordance with the invention described in claim 1, since the front and rear oscillating side walls are opened, it is easy to perform a maintenance and a cleaning. Further, since the right and left stationary side walls are connected by two support shafts and one connection member, it is possible to make rigidity of the shredder large. Further, since two support shafts serve double as the pivot axes of the oscillating side walls and the connection members connecting the right and left stationary side walls, it is possible to reduce the number of the parts so as to reduce a cost.

(2) In accordance with the invention described in claim 1, since the intermediate member of the cover member is detachably provided, it is easy to perform a maintenance.

(3) In accordance with the invention described in claim 3, it is easy to fix the intermediate member of the cover member.

(4) In accordance with the invention described in claim 4, since it is possible to independently adjust the positions of the front member and the rear member in the stationary blade, it is easy to adjust the position of the stationary blade with respect to the rotary blade (the roughly cutting rotary blade and the finely cutting rotary blade).

(5) In accordance with the invention described in claim 5, since it is possible to discharge the material to be treated to the inner side by the spiral portions, it is possible to prevent a trouble that the rotation of the rotary shaft is prevented by the material to be treated.

BEST MODE FOR CARRYING OUT THE INVENTION

A description will be given below of an embodiment in accordance with the present invention.

Figure 1:
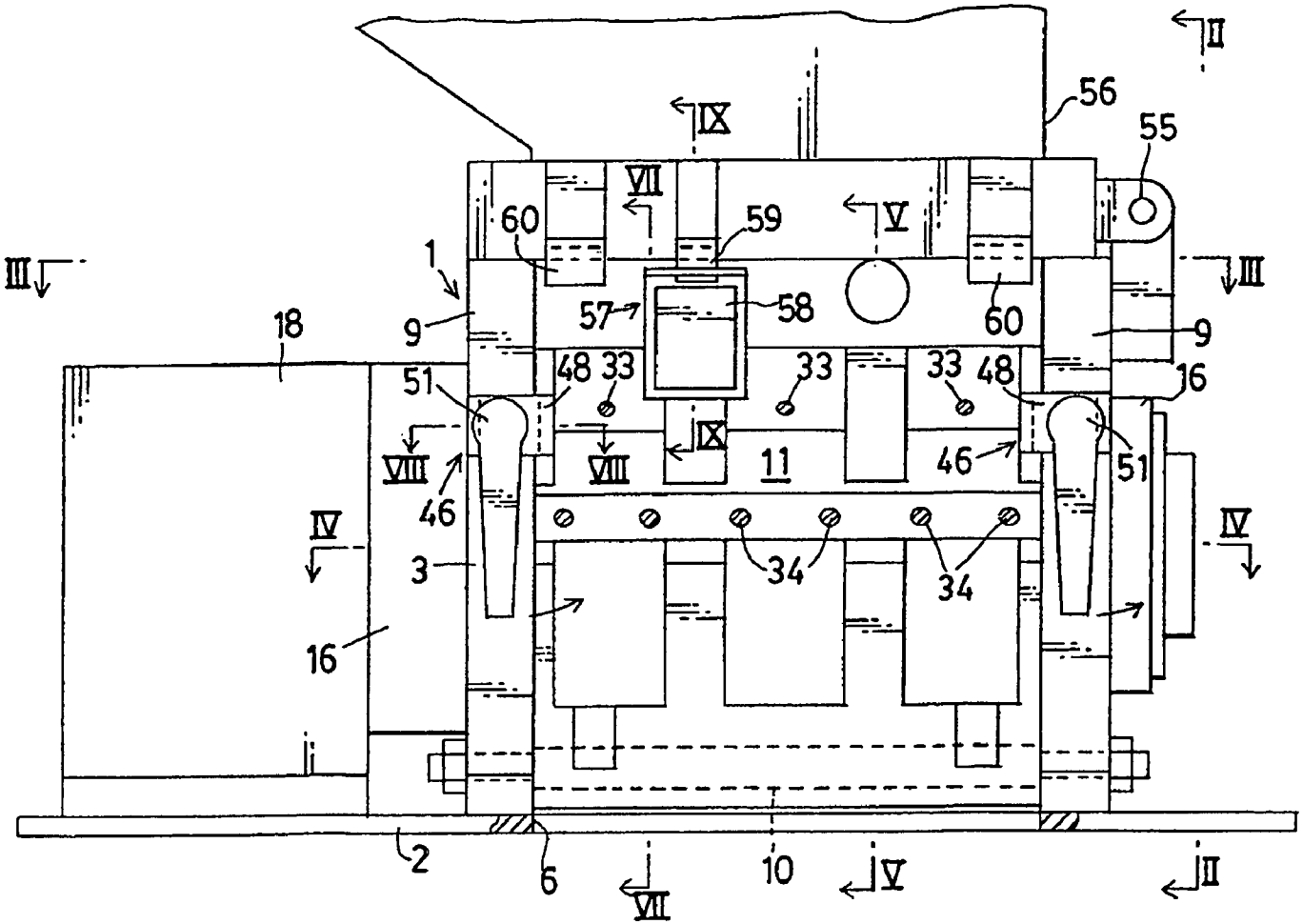
FIG. 1 is a front view of a main portion showing an embodiment in accordance with the present invention.
Figure 2:
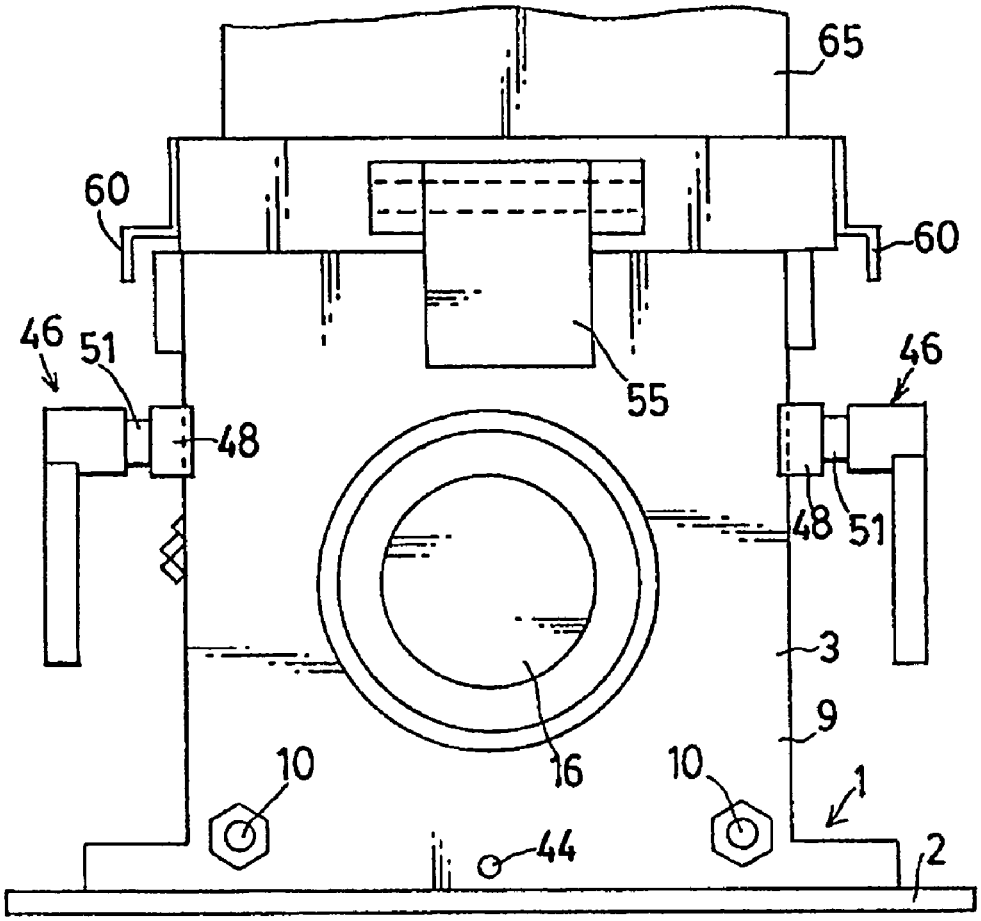
FIG. 2 is a cross sectional view along a line II—II in FIG. 1.

In this case, in the description, front means a top side of a paper surface in FIG. 1, rear means a back side of the same, left means a left side in FIG. 1, and right means a right side in FIG. 1.

A casing 3 mounted to a horizontal base plate 2 of a shredder 1 has an inlet 4 in an upper portion and an outlet 5 in a lower portion. An opening 6 is formed in the base plate 2 so as to oppose to the outlet 5. A receiving box (not shown) for receiving shredded pieces is arranged below the opening 6 of the base plate 2.

The casing 3 has right and left stationary side walls 9 arranged with a predetermined interval in the right-and-left direction, front and rear support shafts 10 bridged and fastened over lower portions of front and rear portions of the stationary side walls 9, front and rear oscillating side walls 11 provided to the support shafts 10 so as to freely oscillate forward and backward and to be opened and closed, and a connection member 12 bridged and fastened over upper front portions of the right and left stationary side walls 9. The support shafts 10 have a function of pivot shafts supporting the oscillating side walls 11 so as to freely oscillate, and connection members connecting the stationary side walls 9. In this case, the front oscillating side wall 11 is structured such that the front oscillating side wall 11 does not oscillate rearward beyond a position shown in FIG. 5 by being brought into contact with the connection member 12, and the rear oscillating side wall 11 is structured such that the rear oscillating side wall 11 does not oscillate frontward beyond a position shown in FIG. 5 by being brought into contact with a stopper (provided in the stationary side wall 9) (not shown).

Figure 4:
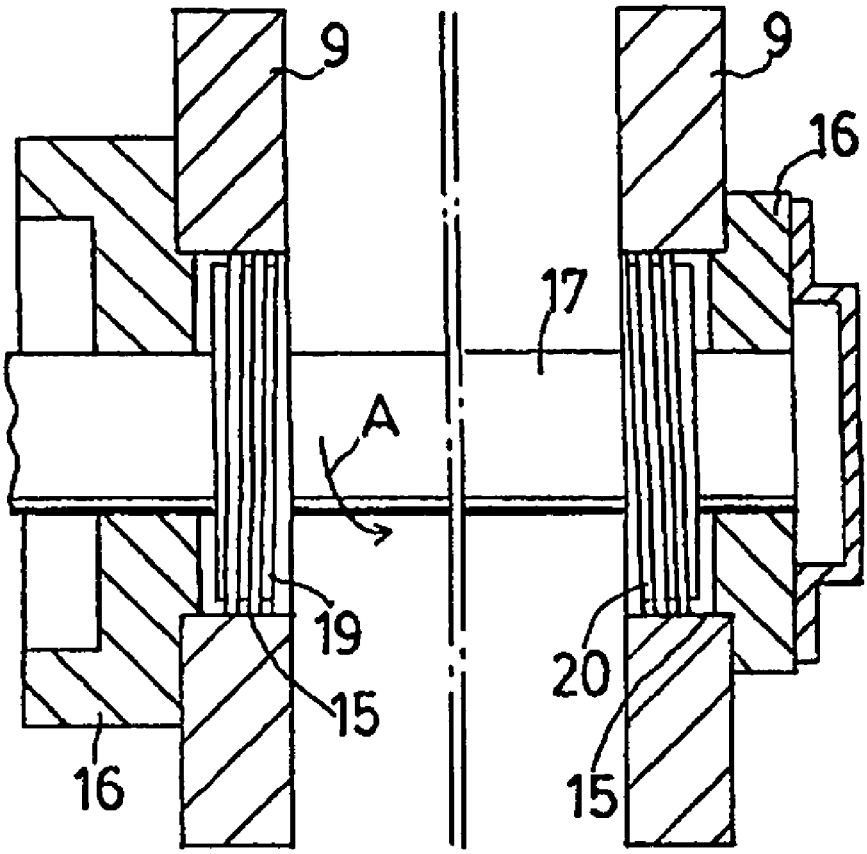
FIG. 4 is a cross sectional view showing only a main portion along a line IV—IV in FIG. 1 from which an intermediate portion is omitted.

As shown in FIG. 4, coaxial through holes 15 having right-and-left directed axes are formed in the stationary side walls 9, bearings 16 are mounted to the through holes 15, and a rotary shaft 17 having a right-and-left directed axis is rotatably bridged over the bearings 16. The rotary shaft 17 is structured such that the rotary shaft 17 is rotated by a motor 18 (refer to FIG. 1) in the direction of an arrow A. Further, a left spiral portion 19 is formed on an inner portion of a left end portion of the rotary shaft 17, a right spiral portion 20 is formed on an inner portion of a right end portion thereof, and the left and right spiral portions 19 and 20 are formed so as to oppose to the inner surfaces of the through holes 15. On the basis of the structure mentioned above, a material to be treated (including the shredded pieces) entered into a portion between the left and right spiral portions 19 and 20 and the inner surfaces of the through holes 15 is discharged to an inner portion of the casing 3, in accordance with a rotation of the rotary shaft 17 in the direction of the arrow A.

At least one, two in the present embodiment, arm-shaped roughly cutting rotary blades 23 are fitted and fastened to the rotary shaft 17 mentioned above so as to have a predetermined interval in the right-and-left direction and to be spaced with respect to the stationary side walls 9. Further, at least one, three in the present embodiment, finely cutting rotary blades 24 are fitted and fastened to the rotary shaft 17. In this case, the adjacent roughly cutting rotary blade 23 and finely cutting rotary blade 24 are closely contacted with each other, and the left most and right most finely cutting rotary blades 24 are opposed to the stationary side walls 9 with slight spaces so as not to prevent the rotation thereof. A rectangular hole 25 for a rotary tool is formed in the roughly cutting rotary blade 23. In accordance with the structure mentioned above, it is possible to fit the rotary tool to the rectangular hole 25 so as to manually rotate the roughly cutting rotary blade 23. Annular grooves 27 are formed in the finely cutting rotary blade 24 with a predetermined interval in the right-and-left direction, and a sawtooth-shaped shredding teeth 29 are formed in a protruding portion 28 between the annular groove 27 and the annular groove 27 (refer to FIG. 7).

Figure 3:
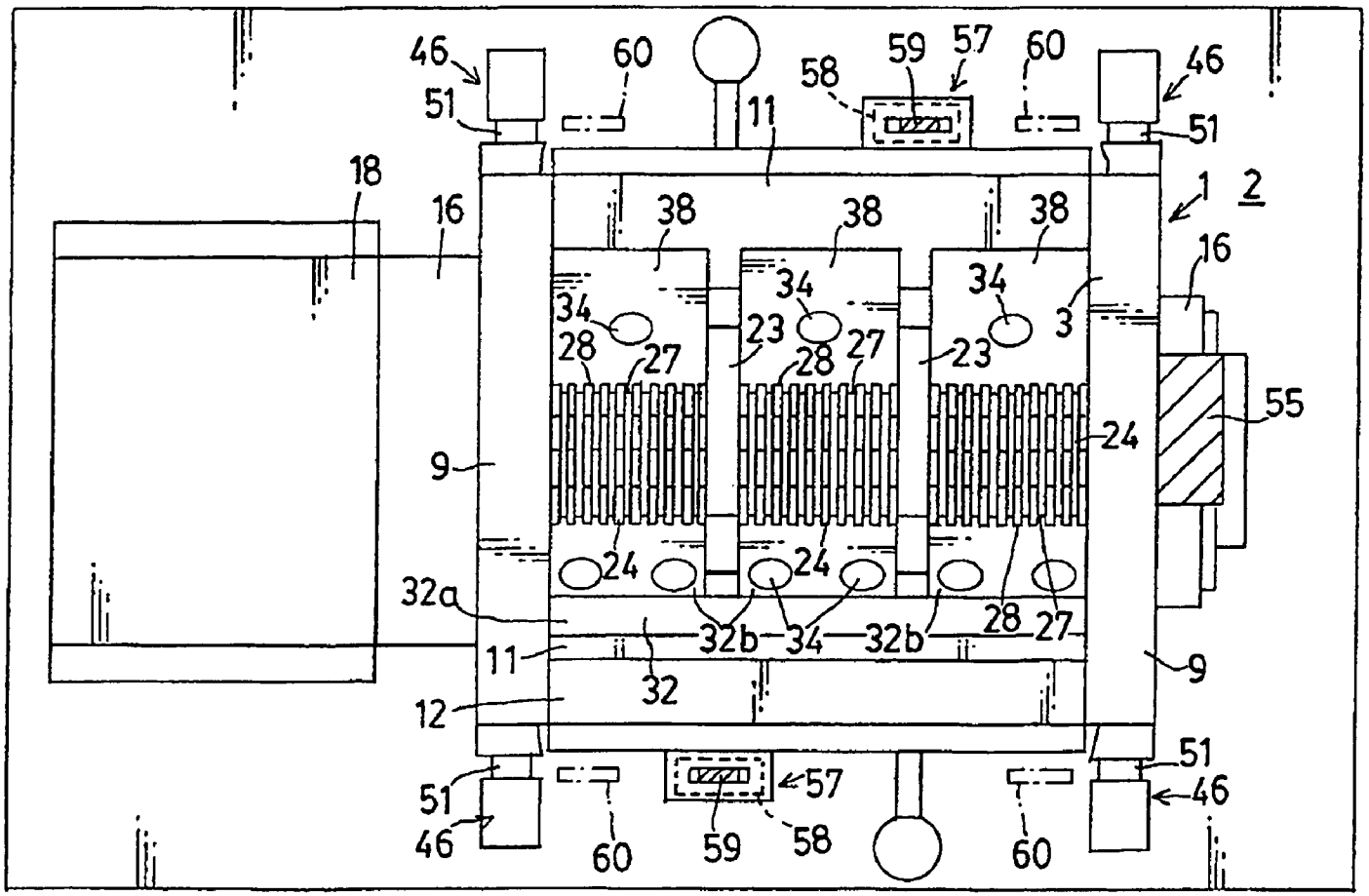
FIG. 3 is a cross sectional view along a line III—III in FIG. 1.

A stationary blade 32 for shredding the material to be treated in cooperation with the roughly cutting rotary blade 23 and the finely cutting rotary blade 24 is mounted to an inner side of the front oscillating side wall 11 so as to decline rearward. The stationary blade 32 has a front member 32*a* which is long in the right-and-left direction and is positioned in a front side of a moving locus of a leading end of the roughly cutting rotary blade 23, and a rear member 32*b* (refer to FIG. 3) which is provided independently from the front member 32*a* and is separated at a position of a moving locus of the roughly cutting rotary blade 23.

Figure 7:
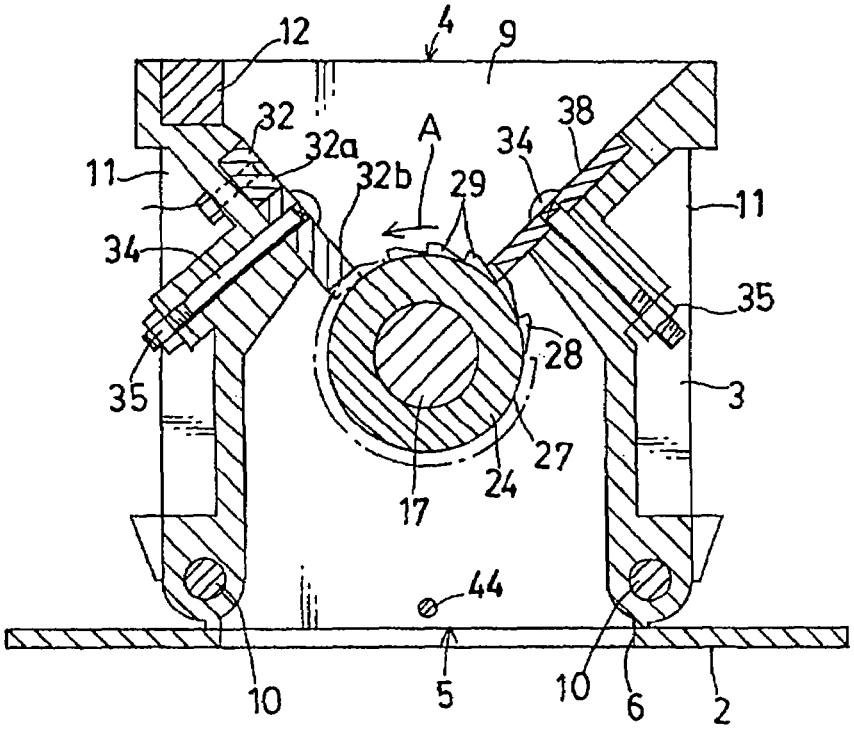
FIG. 7 is a cross sectional view along a line VII—VII in FIG. 1.

The front member 32*a* is fixed to the front oscillating side wall 11 by a desired number of bolts 33 as shown in FIG. 7, and a rear edge portion facing to the moving locus of the roughly cutting rotary blade 23 functions as a blade (a blade for shredding the material to be treated in cooperation with the roughly cutting rotary blade 23).

The rear member 32*b* is fixed to the front oscillating side wall 11 by a desired number of bolts 34 and nuts 35 as shown in FIG. 7, and a rear edge portion facing to the moving locus of the roughly cutting rotary blade 23 functions as a blade (a blade for shredding the material to be treated in cooperation with the roughly cutting rotary blade 23). Further, the rear edge portion of the rear member 32*b* is formed in a concavo-convex shape so as to be engaged with the finely cutting rotary blade 24 (refer to FIG. 3), and the concavo-convex portion serves as a blade (a blade for shredding the material to be treated in cooperation with the finely cutting rotary blade 24). A head of the bolt 34 is formed in an upward convex curved shape having no recess to which the treated material may be fitted. Further, an upper portion of a shaft portion (a portion below the head portion) of the bolt 34 is formed to be a rectangular shaft portion (a shaft having a rectangular cross section), and the rectangular shaft portion is fitted to the rectangular hole formed in the rear member 32*b*, thereby preventing the bolt 34 from relatively rotating with respect to the rear member 32*b*.

Three scrapers 38 for scraping out the treated material in cooperation with the finely cutting rotary blade 24 are mounted to the inner side of the rear oscillating side wall 11 so as to decline frontward. The scrapers 38 are arranged so as to be prevented from being collided and interfered with the roughly cutting rotary blade 23. The scrapers 38 are fixed to the rear oscillating side wall 11 by desired number of bolts 34 and nuts 35 as shown in FIG. 7, a front edge portion of each of the scrapers 38 is formed in a concavo-convex shape (refer to FIG. 3) so as to be engaged with the finely cutting rotary blade 24, and the concavo-convex portion serves as a scraping portion (a portion for scraping out the treated material in cooperation with the finely cutting rotary blade 24).

In accordance with the structure mentioned above, the roughly cutting rotary blade 23 and the finely cutting rotary blade 24 are positioned between the stationary blade 32 and the scraper 38.

Figure 5:
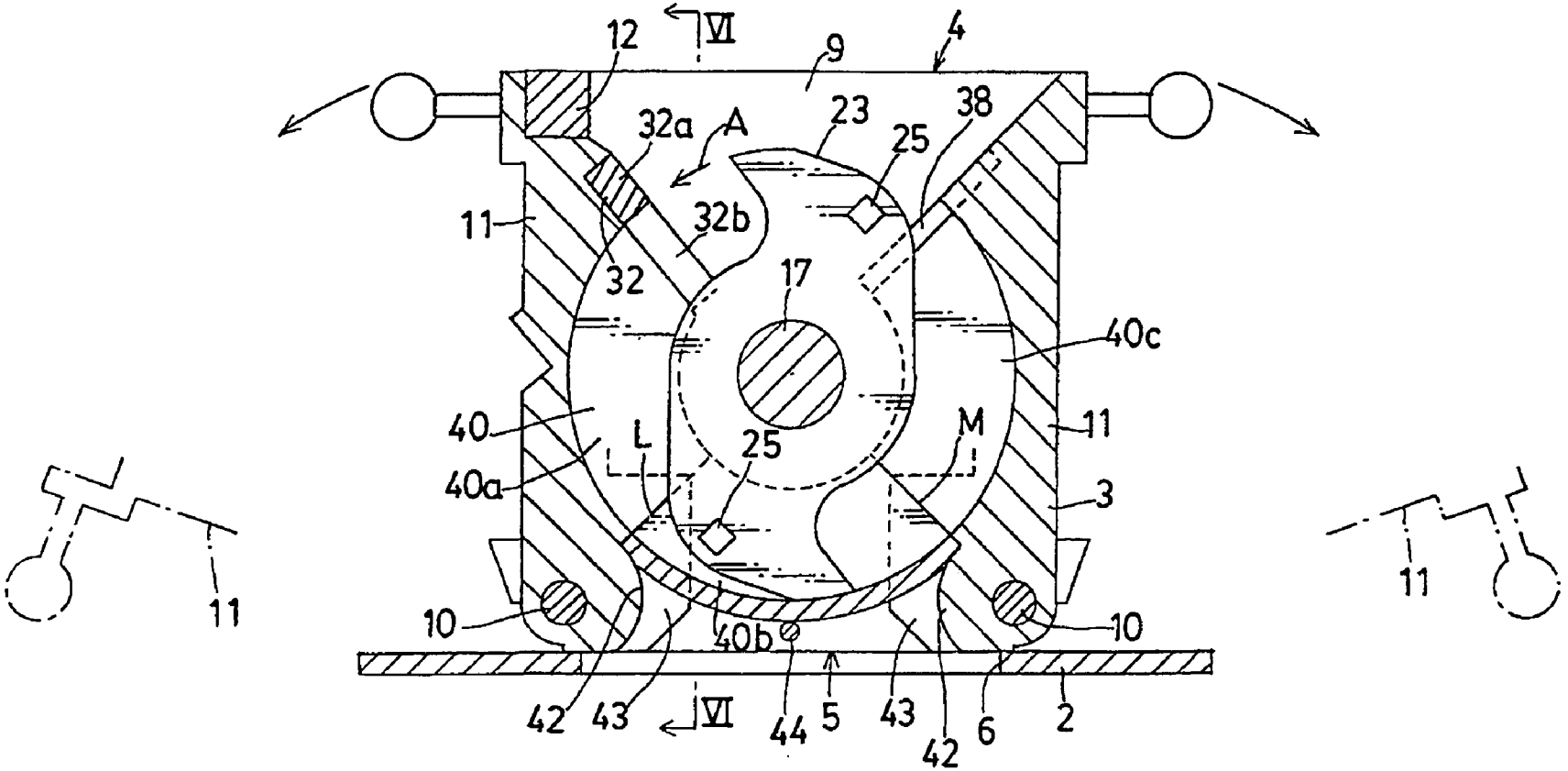
FIG. 5 is a cross sectional view along a line V—V in FIG. 1.
Figure 6:
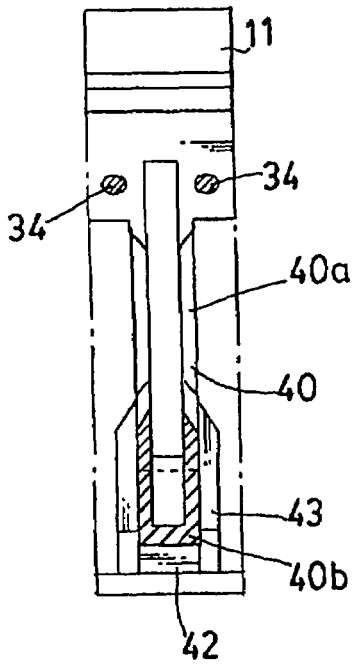
FIG. 6 is a cross sectional view along a line VI—VI in FIG. 5 from which a stationary blade is deleted.

As shown in FIGS. 5 and 6, a cover member 40 for covering a moving locus space of the roughly cutting rotary blade 23 is provided so as to be positioned below the stationary blade 32 and the scraper 38. The cover member 40 has a front member 40*a* provided in the front oscillating side wall 11, a rear member 40*c* provided in the rear oscillating side wall 11, and an intermediate member 40*b* connecting the front member 40*a* and the rear member 40*c* and provided independently therefrom. In this case, in FIG. 5, a boundary between the front member 40*a* and the intermediate member 40*b* is shown by "L", and a boundary between the intermediate member 40*b* and the rear member 40*c* is shown by "M".

The intermediate member 40*b* is provided so as to be freely attached to and detached from the casing 3 by the following means.

The front and rear oscillating side walls 11 are provided with bearing members 42 for bearing the intermediate member 40*b* of the cover member 40 in the state of the front and rear oscillating side walls 11 being opened. Further, the front and rear oscillating side walls 11 are provided with a holder 43 for inhibiting the intermediate member 40*b* from moving rightward and leftward. Further, the structure is made such that the intermediate member 40*b* is inhibited from moving frontward and rearward at a time of closing the front and rear oscillating side walls 11 (at a time of setting them to an upright state) by means of the front and rear bearing members 42, the front member 40*a* and the rear member 40*c*, and is also inhibited from moving rightward and leftward by means of the holder 43. Further, a supporting rod 44 supporting the lower portion of the intermediate member 40*b* in the fixed state as mentioned above is bridged and fastened over the lower portions of the right and left stationary side walls 9. The supporting rod 44 serves as a rod for supporting the intermediate member 40*b* at a time of bridging the intermediate member 40*b* of the cover member 40 between the bearing members 42 in the state of the front and rear oscillating side walls 11 being opened. In accordance with the structure mentioned above, since it is possible to easily take out the intermediate member 40*b* from the casing 3 by opening the front end rear oscillating side walls 11, it is possible to easily clean the inner side of the intermediate member 40*b*.

Figure 8:
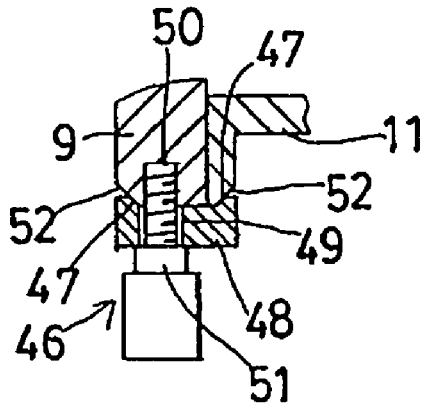
FIG. 8 is a cross sectional view along a line VIII—VIII in FIG. 1.
Figure 9:
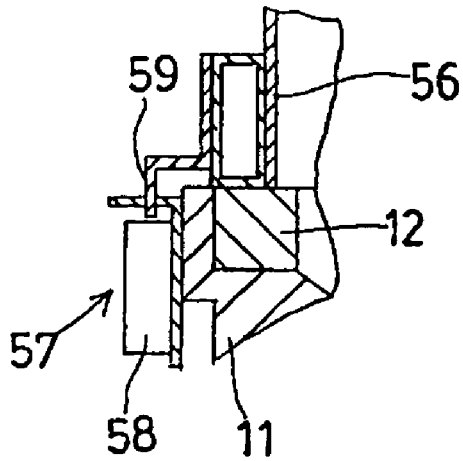
FIG. 9 is a cross sectional view along a line IX—IX in FIG. 1.

The front and rear oscillating side walls 11 are structured such as to be locked by lock apparatuses 46 shown in FIG. 8 at the position shown in FIG. 5.

The lock apparatus 46 has a lock piece 48 having taper surfaces 47, which oppose to each other and open toward a leading end side as seen from the above, and being formed in a C shape in a plan view, a handled screw 51 screwed into a threaded hole 50 formed in the stationary side wall 9 through a through hole 49 formed in the lock piece 48, an inclined surface 52 formed in the stationary side wall 9 so as to oppose to the taper surface 47, and an inclined surface formed in the oscillating side wall 11. In accordance with the structure mentioned above, the oscillating side wall 11 can be locked to the stationary side wall 9 by opposing the taper surfaces 47 to the inclined surfaces 52 and thereafter fastening the screw 51 so as to press the taper surfaces 47 against the inclined surfaces 52.

A hopper 56 is provided in the right stationary side wall 9 via a hinge 55 so as to freely oscillate and to be opened and closed. In this case, the hopper 56 is structured such as to be fixed to the left stationary side wall 9 by a known lock apparatus (not shown) in the state shown in FIG. 1.

Interlocking apparatuses 57 are provided in the hopper 56 and the oscillating side walls 11. The interlocking apparatus 57 has a reflection type photoelectric switch 58 provided in the upper portion of the oscillating side wall 11, and a detected piece 59 provided in the hopper 56, which is to be detected by the photoelectric switch 58 in the state shown in FIG. 1. Further, the structure is made such that the motor 18 is not operated even by turning on the main switch of the shredder 1, until the photoelectric switch 58 detects the detected piece 59, that is, until the oscillating side wall 11 is closed (in the upright state) and the hopper 56 is in the state of being mounted on the casing 3. Receiving pieces 60 inhibiting the oscillating side wall 11 from accidentally opening are provided in the lower portion of the hopper 56.

An operation of the shredder 1 is the same as the conventional one.

A description will be given below of modified embodiments and the like.

(1) The roughly cutting rotary blade 23 and the finely cutting rotary blade 24 correspond to the rotary blade in claim 1. The structures of the roughly cutting rotary blade 23 and the finely cutting rotary blade 24 are optional.

(2) The interlocking apparatus 57 may be omitted.

INDUSTRIAL APPLICABILITY

The present invention can be widely applied to shredding of various raw materials.

What is claimed is:

1. A shredder comprising:

right and left stationary side walls arranged with a predetermined interval;

front and rear support shafts bridged and fastened over lower portions of front and rear portions in the stationary side walls;

front and rear oscillating side walls provided to the support shafts so as to freely oscillate forward and backward and to be opened and closed;

connection members bridged and fastened over upper front portions of the right and left stationary side walls;

a rotary shaft rotatably bridged over the stationary side walls and having a rotary blade;

a stationary blade provided in an inner side of the front oscillating side wall and shredding a material to be treated in cooperation with the rotary blade; and a scraper provided in an inner side of the rear oscillating side wall, wherein the rotary blade includes:

an arm-shaped roughly cutting rotary blade; and a finely cutting rotary blade having sawtooth-shaped shredding teeth in an outer periphery, and is positioned between the stationary blade and the scraper, and wherein a cover member for covering a moving locus space of the roughly cutting rotary blade is provided so as to be positioned below the stationary blade and the scraper, and wherein said cover member has a front member provided in the front oscillating side wall, a rear member provided in the rear oscillating side wall and an independent intermediate member connecting the front member to the rear member, said intermediate member being detachably provided, said front and rear oscillating side walls being provided with bearing members for bearing the intermediate member of the cover member in the state of the front and rear oscillating side walls being opened, and the intermediate member of the cover member being structured so as to be prevented from moving frontward and rearward when the front and rear oscillating side walls are in an upright state, by the bearing member and the front member of the cover member provided in the front oscillating side wall, and the bearing member and the rear member of the cover member provided in the rear oscillating side wall.

2. A shredder as claimed in claim 1, wherein said stationary blade has a front member which is long in the right-and-left direction and is positioned in a in a radially outer side of a moving locus of a leading end of the roughly cutting rotary blade, and wherein at least two rear members are provided independently from the front member, and each of the at least two rear members is separated from another of the at least two rear members in the right-and-left direction at a position of the moving locus of the roughly cutting rotary blade.

3. A shredder as claimed in claim 1, wherein each stationary side wall includes a through hole that is co-axial with the rotary shaft, and left and right end portions of the rotary shaft each insert into the through hole of the respective stationary side wall, wherein a left spiral is formed on a left end portion of said rotary shaft, wherein a right spiral is formed on a right end portion of said rotary shaft, and wherein the right spiral and left spiral are arranged so as to oppose to an inner surface of the respective through hole.

4. A shredder as claimed in claim 2, wherein each stationary side wall includes a through hole that is co-axial with the rotary shaft, and left and right end portions of the rotary shaft each insert into the through hole of the respective stationary side wall, wherein a left spiral is formed on a left end portion of said rotary shaft, wherein a right spiral is formed on a right end portion of said rotary shaft, and wherein the right spiral and left spiral are arranged so as to oppose to an inner surface of the respective through hole.

* * * * *